US009114628B2

(12) United States Patent
Sakai

(10) Patent No.: US 9,114,628 B2
(45) Date of Patent: Aug. 25, 2015

(54) PRINT CONTROL APPARATUS AND PRINT CONTROL METHOD

(71) Applicant: SEIKO EPSON CORPORATION, Tokyo (JP)

(72) Inventor: Hirofumi Sakai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/073,728

(22) Filed: Nov. 6, 2013

(65) Prior Publication Data

US 2014/0125725 A1 May 8, 2014

(30) Foreign Application Priority Data

Nov. 8, 2012 (JP) ..... 2012-246350

(51) Int. Cl.
*B41J 2/205* (2006.01)
*B41J 2/21* (2006.01)

(52) U.S. Cl.
CPC ..... *B41J 2/2114* (2013.01); *B41J 2/2132* (2013.01)

(58) Field of Classification Search
CPC ..... B41J 2/2054; B41J 2/2128; B41J 2/2132; B41J 2/0458; G06K 15/102; H04N 1/40087
See application file for complete search history.

(56) References Cited

U.S. PATENT DOCUMENTS

| | | | | |
|---|---|---|---|---|
| 7,121,660 | B2 * | 10/2006 | Ide et al. | 347/101 |
| 2004/0169710 | A1 | 9/2004 | Ide et al. | |
| 2005/0068347 | A1 | 3/2005 | Inoue | |
| 2006/0061625 | A1 * | 3/2006 | Konno et al. | 347/55 |
| 2009/0244118 | A1 * | 10/2009 | Kakutani | 347/6 |
| 2010/0053247 | A1 * | 3/2010 | Kakutani | 347/12 |
| 2010/0134811 | A1 | 6/2010 | Fukasawa et al. | |
| 2010/0167023 | A1 | 7/2010 | Oyanagi et al. | |
| 2010/0178474 | A1 | 7/2010 | Oyanagi et al. | |
| 2010/0320744 | A1 | 12/2010 | Ishibashi | |
| 2012/0262509 | A1 * | 10/2012 | Sakai et al. | 347/6 |
| 2012/0313990 | A1 | 12/2012 | Sakai | |

FOREIGN PATENT DOCUMENTS

| | | | |
|---|---|---|---|
| JP | 2011-000870 | A | 1/2001 |
| JP | 2001-212927 | A | 8/2001 |
| JP | 2001-225459 | A | 8/2001 |
| JP | 2004-098017 | A | 4/2004 |
| JP | 2004-122496 | A | 4/2004 |
| JP | 2005-052971 | A | 3/2005 |
| JP | 2010-130405 | A | 6/2010 |
| JP | 2010-149484 | A | 7/2010 |
| JP | 2010-158849 | A | 7/2010 |
| JP | 2010-179518 | A | 8/2010 |
| JP | 2012-223903 | A | 11/2012 |
| JP | 2012-250514 | A | 12/2012 |
| JP | 2013-009063 | A | 1/2013 |

* cited by examiner

*Primary Examiner* — Manish S Shah
*Assistant Examiner* — Jeremy Delozier
(74) *Attorney, Agent, or Firm* — Workman Nydegger

(57) ABSTRACT

A print control apparatus capable of carrying out printing on a print medium using metallic ink, controls unevenness of a metallic ink layer formed by the metallic ink on the print medium and also controls coarseness and fineness of dots of the metallic ink on the print medium.

8 Claims, 9 Drawing Sheets

PRINT CONTROL APPARATUS AND PRINT CONTROL METHOD

BACKGROUND

1. Technical Field

The present invention relates to print control apparatuses and print control methods.

2. Related Art

Printers capable of printing on print media using metallic ink are widely known. Using metallic ink makes it possible to give a special quality of glossiness, a metal-like quality, and the like (hereinafter, called "metallic quality" as a generic designation) to a user who takes a look at a printed result.

The following technique is well-known: that is, a printing plate member having an image forming layer on its surface is prepared and set, then a solvent for dissolving the image forming layer is discharged from an ink jet recording head and attached to the image forming layer, thereby dissolving the image forming layer (see JP-A-2001-212927).

In addition, the decorative member in which a print layer is superimposed on a light-reflective metal layer having a parallel-line convex-concave pattern is also well-known (see JP-A-2010-179518).

A plurality of quality types are present in the metallic quality realized by using metallic ink. Of those quality types, a type that gives a variegated (non-uniform) glossiness or a glossiness with granular quality on a surface of the printed result, a type that gives a uniform or mirror surface-like quality of glossiness on the surface of the printed result, and the like can be cited, for example. What quality type should be realized depends on a request from a user. Accordingly, such a print technique has been required that is capable of reproducing the metallic quality requested by a user in a printed result with high precision in a more flexible manner. However, the patent documents mentioned above do not propose a solution method to meet such requirement from the user.

SUMMARY

An advantage of some aspects of the invention is to provide a technique that is capable of controlling the metallic quality of a printed result produced by using metallic ink with high precision in a flexible manner.

A print control apparatus according to an aspect of the invention is a print control apparatus that is capable of carrying out printing on a print medium using metallic ink, and controls unevenness of a metallic ink layer formed by the metallic ink on the print medium as well as coarseness and fineness of dots of the metallic ink on the print medium.

According to this configuration, since the unevenness of the metallic ink layer formed on the print medium and the coarseness and fineness of the metallic ink dots on the print medium are controlled, it is possible to adjust the metallic quality of a printed result produced by using the metallic ink in accordance with the request from a user in a flexible manner, and reproduce the metallic quality with high precision that is requested by the user.

According to an aspect of the invention, it is preferable that the print control apparatus control the unevenness of the metallic ink layer by adjusting use rates of a plurality of dots in different sizes of the metallic ink.

According to an aspect of the invention, it is preferable that the print control apparatus attach, to the print medium, a solvent for dissolving a surface of the print medium to form unevenness on the surface thereof before the metallic ink layer being formed on the print medium, thereby controlling the unevenness of the metallic ink layer.

According to an aspect of the invention, it is preferable that the print control apparatus adjust a shape of the unevenness on the surface by adjusting sizes of dots of the solvent to be attached to the print medium.

According to an aspect of the invention, it is preferable that the print control apparatus adjust the shape of the unevenness on the surface of the print medium by adjusting use rates of a plurality of the solvents having different capabilities to dissolve the surface of the print medium.

According to an aspect of the invention, it is preferable that the print control apparatus adjust the shape of the unevenness on the surface by adjusting coarseness and fineness of dots of the solvents to be attached to the print medium.

According to an aspect of the invention, it is preferable that the print control apparatus control the coarseness and fineness of the metallic ink dots by changing a method of halftone processing that determines whether or not to form the metallic ink dots at each individual position in the print medium.

The technical spirit according to this invention may be realized not only in an embodiment as a print control apparatus, but also in other products (apparatuses). Moreover, an invention of a method including a process that corresponds to the characteristics of the print control apparatus according to any one of the above aspects (print control method), an invention of a print control program that makes a predetermined hardware system (computer) execute the above method, an invention of a computer-readable recording medium that stores the above program, and so on can be comprehended. The print control apparatus may be realized by a single apparatus or a plurality of apparatuses being combined together. In addition, the print control apparatus may be realized by a single printing apparatus having a print function.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

1. Outline of Apparatus

Figure 1:
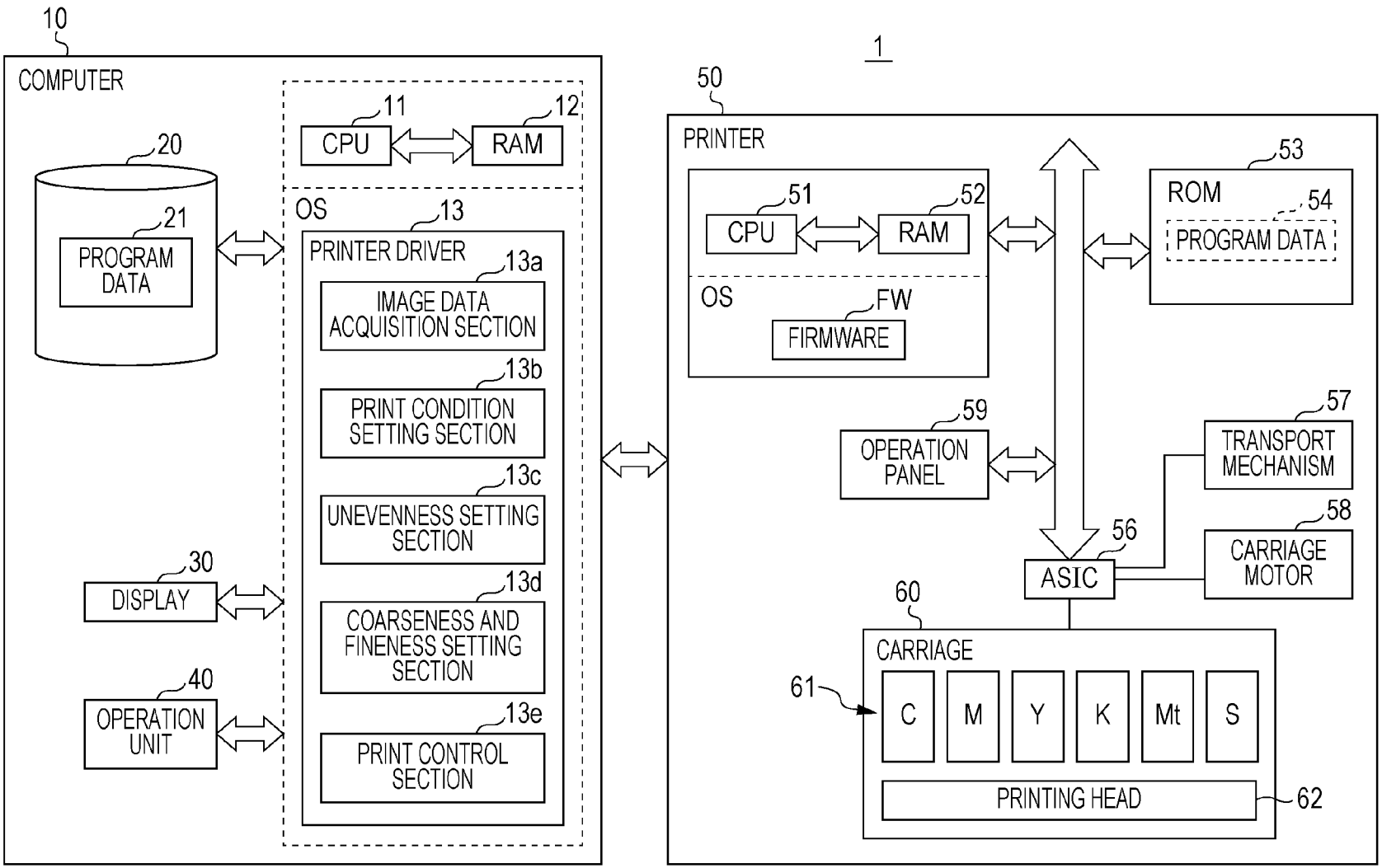
FIG. 1 is a diagram illustrating a hardware configuration and a software configuration.

FIG. 1 illustrates a hardware configuration and a software configuration according to the embodiment. In FIG. 1, a computer 10 as a personal computer (PC) and a printer 50 are illustrated. The computer 10 and/or the printer 50 correspond to a print control apparatus. Further, the computer 10 and/or the printer 50 also correspond to a printing apparatus. Furthermore, it can be stated that the computer 10 and the printer 50 configure a single printing system 1. In the computer 10, a CPU 11 loads program data 21 stored in a hard disk drive (HDD) 20 or the like into a RAM 12 and performs computing in accordance with the program data 21 under the control of an OS, whereby a printer driver 13 configured to control the printer 50 is executed. The printer driver 13 is a program that makes the CPU 11 execute the functions of an image data acquisition section 13*a*, a print condition setting section 13*b*, an unevenness setting section 13*c*, a coarseness and fineness setting section 13*d*, a print control section 13*e*, and so on. These functions will be described in detail later.

A display 30 as a display unit is connected to the computer 10, and a user interface screen (UI) needed in the respective processes is displayed on the display 30. Further, the computer 10 is appropriately equipped with an operation unit 40 implemented by, for example, a keyboard, a mouse, a touch pad, a touch panel, and so on. Instructions needed in the respective processes are inputted by a user through the operation unit 40. Furthermore, the printer 50 is connected to the computer 10. In the computer 10, as will be described in detail later, a print command is generated by a function of the printer driver 13 based on image data expressing a print target image, and is transmitted to the printer 50.

In the printer 50, a CPU 51 loads program data 54 stored in a memory unit such as a ROM 53 or the like into a RAM 52 and performs computing in accordance with the program data 54 under the control of an OS, whereby firmware FW configured to control the printer 50 is executed. The firmware FW interprets a print command transmitted from the computer 10, extracts print data, and sends it to an ASIC 56, whereby the printing based on the print data can be performed. Further, the firmware FW can acquire image data expressing a print target image from a memory card mounted to a connector for external connection (not shown), an external apparatus (computer 10, for example), or the like, and create print data based on the acquired image data. Even in the case where the print data is created by the above function of the firmware FW, the print data is sent to the ASIC 56.

The ASIC 56 acquires the print data and generates driving signals for driving a transport mechanism 57, a carriage motor 58, and a printing head 62 in accordance with the print data. The printer 50 is equipped with a carriage 60, and ink cartridges 61 respectively corresponding to a plurality of colors of ink are mounted in the carriage 60. In the example of FIG. 1, the ink cartridges 61 each corresponding to different ink colors of cyan (C), magenta (M), yellow (Y), black (K), metallic (Mt), and solvent (S) are mounted. In this embodiment, metallic (Mt) ink refers to, for example, ink that contains metallic pigment and expresses a metallic quality, and various types of Mt ink including known Mt ink can be employed. Solvent (S) ink refers to liquid having a function that dissolves a certain type of print medium (vinyl chloride-based medium, for example) when being attached to the stated print medium. As a solvent to be contained in the solvent ink, an organic polar solvent such as diethylene glycol, diethyl ether, γ-butyrolactone, or the like can be given, for example.

Specific types of ink and the number of types of ink that are available for use in the printer 50 are not limited to those having been described above; for example, various types of ink such as light cyan, light magenta, orange, green, gray, light gray, white, and so on can be used. Further, the ink cartridges 61 may not be mounted in the carriage 60, but be disposed at a predetermined position inside the printer 50.

The carriage 60 includes the printing head 62 that ejects (discharges) ink supplied from the respective ink cartridges 61 through a plurality of nozzles.

Figure 2:
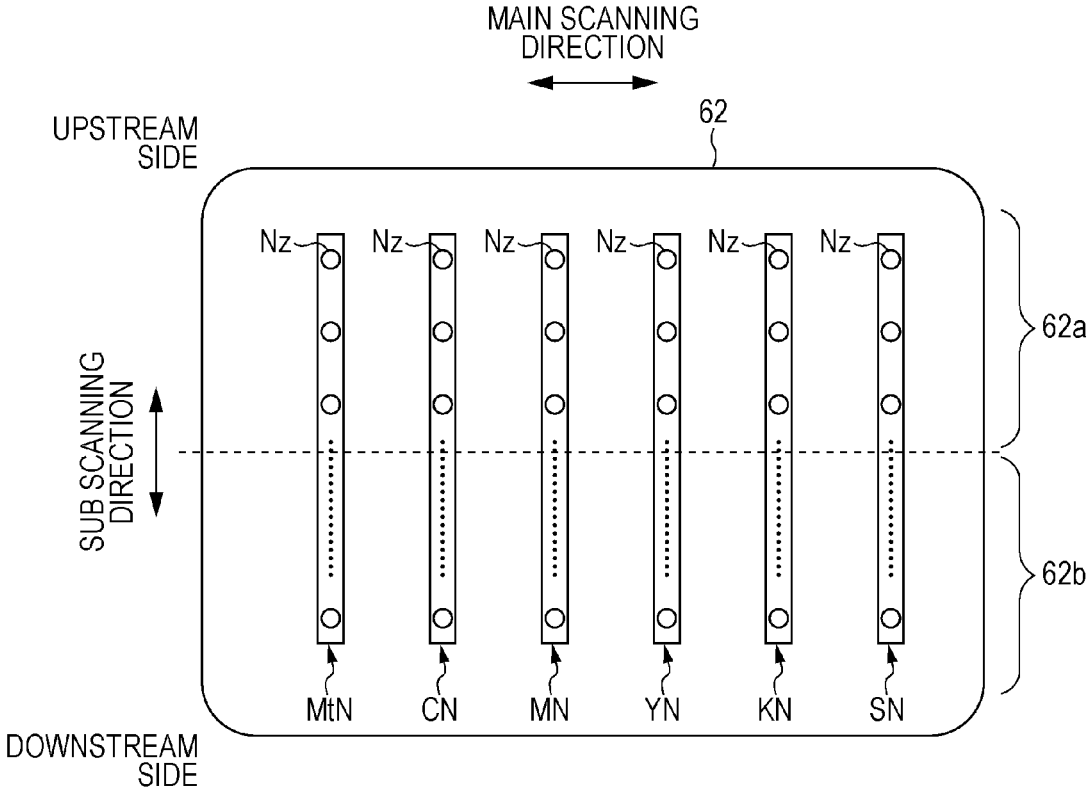
FIG. 2 is a diagram illustrating an example of a nozzle arrangement in a printing head.

FIG. 2 illustrates an example of arrangement of the nozzles on a lower surface (surface opposed to the print medium) of the printing head 62. A plurality of nozzle rows are formed in the lower surface of the printing head 62; in the example of FIG. 2, there are formed a nozzle row MtN configured of a plurality of nozzles Nz for discharging Mt ink, a nozzle row CN configured of a plurality of nozzles Nz for discharging C ink, a nozzle row MN configured of a plurality of nozzles Nz for discharging M ink, a nozzle row YN configured of a plurality of nozzles Nz for discharging Y ink, a nozzle row KN configured of a plurality of nozzles Nz for discharging K ink, and a nozzle row SN configured of a plurality of nozzles Nz for discharging S ink. A plurality of nozzles configuring a single nozzle row are aligned at a predetermined nozzle pitch along a set direction (sub scanning direction). A nozzle row corresponding to one ink type may be configured not only with a single nozzle row aligned along the sub scanning direction, but also with, for example, a plurality of nozzle rows disposed in parallel and shifted by a predetermined pitch in the sub scanning direction.

Piezoelectric elements are provided respectively to the nozzles inside the printing head 62 so as to discharge ink droplets (dots) through the nozzles. The piezoelectric element deforms when a driving signal is applied thereto and makes its corresponding nozzle discharge a dot. In this embodiment, it is possible for the printing head 62 to discharge a plurality of kinds of dots, each of which has a different size (dot diameter) from the others (in other words, a different amount of ink), through each of the nozzles in accordance with the waveform of the driving signal. Here, it is assumed that, for example, two different kinds of dots in size are discharged through each of the nozzles, where a larger dot is called a "large dot" while a smaller dot is called a "small dot". Needless to say, sizes of the dots discharged through each of the nozzles are not limited to the two kinds, and a configuration capable of discharging the dots in three or more different sizes may be employed.

The transport mechanism 57 (FIG. 1) includes a motor, a roller, and the like (not shown), and is controlled and driven by the ASIC 56 to transport a print medium along the sub scanning direction from an upstream side toward a downstream side (see FIG. 2). The orientation of the sub scanning direction from the upstream side toward the downstream side corresponds to a transport direction of the print medium. Further, it is also possible for the transport mechanism 57 to transport the print medium in a direction from the downstream side toward the upstream side, and such transport from the downstream side toward the upstream side is called a "back feed".

The ASIC 56 takes control of driving of the carriage motor 58 so that the carriage 60 (together with the printing head 62) moves (performs main scanning) along a direction substantially orthogonal to the sub scanning direction (main scanning direction), and the ASIC 56 makes the printing head 62 discharge ink through each nozzle at a predetermined timing along with the main scanning. Through this, ink dots are adhered to the print medium and a print target image is formed on the print medium. The printer 50 further includes an operation panel 59. The operation panel 59 includes a display unit (liquid crystal panel, for example), a touch panel formed within the display unit, various types of buttons and keys, and the like, then receives input from a user, displays a necessary UI screen on the display unit, and so on. In addition to the printer 50 being a serial printer type in which the printing head moves in the main scanning direction as described above, the printer 50 may be a type of machine including a line printing head in which a plurality of nozzles are aligned and fixed along the main scanning direction, or the like.

2. Print Control Process

On the premise that the above-described configuration is employed in this embodiment, a print control process in which the printer 50 is made to print a print target image using at least Mt ink will be described hereinafter. The print control process of the embodiment controls unevenness of a metallic ink layer (Mt ink layer) formed on a print medium by Mt ink and coarseness and fineness (sparse and dense) of Mt ink dots on the print medium. There are principally two kinds of processes in the print control process, that is, a process including "preprocessing" and a process not including "preprocessing". The preprocessing refers to processing in which unevenness (roughness) is formed on a surface of the print medium by discharging S ink onto the print medium to dissolve the surface of the print medium before discharging Mt ink or other inks of C, M, Y, and K onto the print medium for forming a print target image. As a specific method to implement the process including the "preprocessing", such a method can be given that the nozzles included in the printer 50 are divided into a plurality of nozzle groups and inks of different types are separately discharged through each of the nozzle groups.

For example, as shown in FIG. 2, the plurality of nozzles Nz included in the printing head 62 are divided into a nozzle group 62*a* on the upstream side and a nozzle group 62*b* on the downstream side substantially at the center position in the sub scanning direction. Then, the preprocessing is performed so that S ink is discharged through the nozzles Nz of the nozzle row SN which belong to the nozzle group 62*a* onto a print medium that passes under the nozzle group 62*a* while being transported along the transport direction. Subsequently, Mt ink or other inks of C, M, Y, and K are discharged through the nozzles Nz belonging to the nozzle group 62*b* onto the print medium, on which the preprocessing has been performed, that passes under the nozzle group 62*b* to form a print target image. Alternatively, the printer 50 may have two separate printing heads, that is, a printing head on the upstream side and a printing head on the downstream side. In other words, the preprocessing is performed so that S ink is discharged from the printing head on the upstream side (first nozzle group) onto a print medium that passes under the printing head on the upstream side while being transported along the transport direction. Then, Mt ink or other inks of C, M, Y, and K may be discharged from the printing head on the downstream side (second nozzle group) onto the print medium, on which the preprocessing has been performed, that passes under the printing head on the downstream side to form a print target image.

Moreover, the back feed may be incorporated in the process for implementing a process including the "preprocessing". That is, after the preprocessing has been performed on a print medium by the nozzle group on the upstream side (printing head on the upstream side), the print medium is pulled back to a predetermined transport start position by the back feed, then the print medium is transported again and Mt ink or other inks of C, M, Y, and K are discharged through the nozzle group on the downstream side (printing head on the downstream side) to form a print target image. In the case where the process including the "preprocessing" is performed incorporating the back feed, it is unnecessary to divide the nozzles included in the printer 50 into a plurality of nozzle groups. It is to be noted that, in the case of printing without the back feed being incorporated, both the preprocessing and the printing of a print target image can be performed in a one-time transport of the print medium along the transport direction, thereby reducing the printing time. On the other hand, in the case of printing with the back feed being incorporated, it is possible to ensure a time for drying S ink during a period of time from when the preprocessing has been performed until when the printing of a print target image is started, thereby making it easier to obtain a better image quality with less bleeding and the like.

Figure 3:
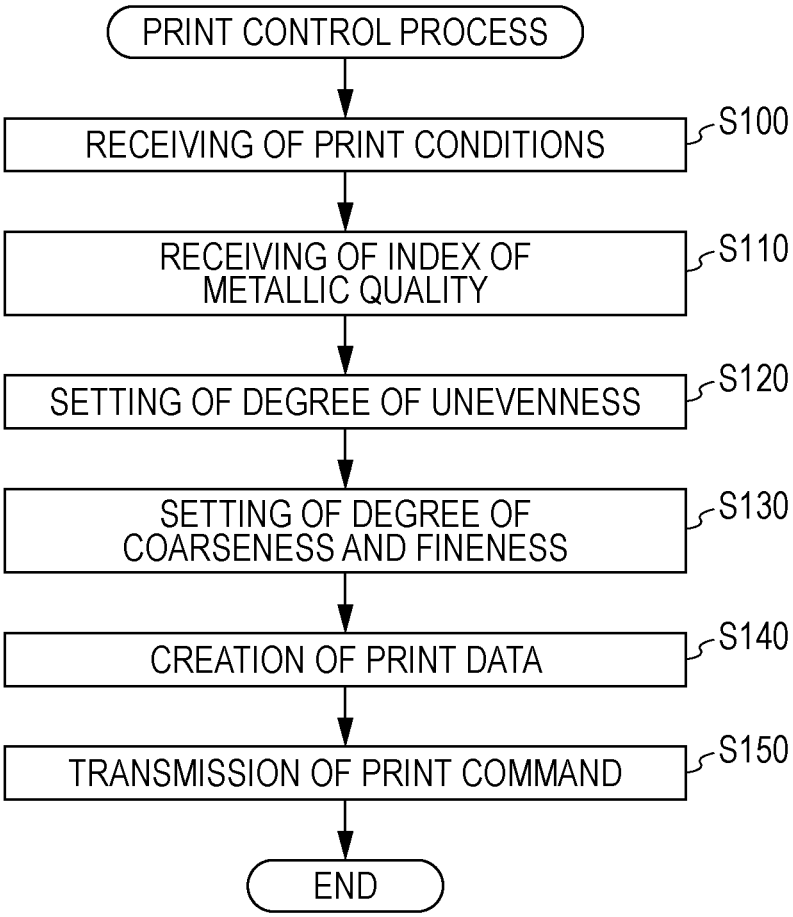
FIG. 3 is a flowchart illustrating a print control process.

FIG. 3 illustrates the print control process of the embodiment in the form of a flowchart. The description below is made assuming that the printer driver 13 (print control program) makes the CPU 11 execute the flowchart. Through the operation unit 40 being operated by a user, arbitrary application software is started and set in a state in which an arbitrary print target image is specified. Then, the user operates the operation unit 40 to display a print condition setting UI screen on the display 30. In this state, the printer driver 13 receives print conditions (step S100). In other words, the print condition setting section 13*b* receives the print conditions in accordance with user input via the UI screen; those print conditions are applied at the time of the printer 50 printing the print target image. For example, various kinds of print conditions such as types of print media, printing speed, orientation of printing, allocation with respect to a medium surface, necessity/unnecessity of double-sided printing, and so on are received in accordance with the user input.

Further, the print condition setting section 13*b* receives an index of the metallic quality in a printed result of the print target image in accordance with the user input (step S110). Here, as a metallic quality recognized by a user when he or she observes a printed matter produced by using Mt ink, a variegated (non-uniform) glossiness (brilliantness) or a glossiness with granular quality, a uniform or mirror surface-like quality of glossiness, and the like can be cited, for example. The variegated (non-uniform) glossiness or the glossiness with granular quality can be expressed as "glittering gloss feeling" or the like according to a general user's sense, and is hereinafter referred to as "first metallic quality". Meanwhile, the uniform or mirror-like quality of glossiness can be expressed as "shiny gloss feeling" or the like according to the general user's sense, and is hereinafter referred to as "second metallic quality". The above index is an index that specifies which of the first and second metallic qualities should be prioritized over the other to what degree; the user can arbitrarily select a desired index from a numerical value range of index, proposed choices, and the like defined and displayed on the UI screen.

Next, the unevenness setting section 13*c* sets a degree of unevenness of the Mt ink layer based on the index of the metallic quality having been received in step S110 (step S120). The unevenness setting section 13*c* sets a higher degree of unevenness as the index specifies a higher priority to the first metallic quality.

The coarseness and fineness setting section 13*d* sets a degree of coarseness and fineness of the Mt ink dots based on the index of the metallic quality having been received in step S110 (step S130). The coarseness and fineness setting section 13*d* sets the degree of coarseness and fineness on a higher density side as the index specifies a higher priority to the first metallic quality.

Next, the print control section 13*e* creates print data based on image data representing the print target image (step S140). Roughly speaking, the print control section 13*e* executes resolution conversion processing that makes the number of pixels in the image data correspond to print resolution of the printer 50, color conversion processing that converts the color system of the image data to the ink color system used by the printer 50, dot assignment processing that assigns the tone of each pixel to the tone of each differently-sized dot (dot forming amount) after the color conversion processing has been executed, halftone (HT) processing that converts the tone of each pixel (dot forming amount) to information (halftone data) in which discharge/non-discharge of dots in any one of the dot sizes is defined, rasterizing processing that creates the print data in which the halftone data is rearranged in the order to be transferred to the printer 50, and so on. The print control section 13*e*, if the process including the "preprocessing" is specified, also creates S ink data that defines the S ink to be discharged in the preprocessing as one type of print data.

The print control section 13*e*, in the processing of creation of the above print data, changes the contents of the processing in accordance with the degree of unevenness set in step S120, the degree of coarseness and fineness set in step S130, and the like. In other words, if the set degree of unevenness, the set degree of coarseness and fineness, or the like differs, the created print data also differs; that is, creating such different print data corresponds to controlling the unevenness of the Mt ink layer and the coarseness and fineness of the Mt ink dots.

Subsequently, the print control section 13*e* generates a print command including the print data and transmits it to the printer 50 (step S150). The print command also includes setting information about the received print conditions, setting information about the presence/absence of the preprocessing as well as the presence/absence of the back feed, and the like. As a result, the printer 50 performs the printing according to the print command having been transmitted thereto.

First Example

Next, a specific example of the print control process according to FIG. 3 will be described as a first example. In the first example, a case in which the process including the "preprocessing" is employed will be described. Whether or not to include the "preprocessing" depends on the type of the print medium that has been received via a user input in step S100, for example. The print condition setting section 13*b* sets the process as the one including the "preprocessing" in the case where the type of the print medium having been received is a predetermined type of print medium (vinyl chloride-based medium, for example) which suitable for the preprocessing. On the other hand, the print condition setting section 13*b* sets the process as the one not including the "preprocessing" in the case where the type of the print medium having been received is a predetermined type of print medium (PET film, for example) which is unsuitable for the preprocessing (unlikely to be dissolved even if S ink being attached thereto). Alternatively, the print condition setting section 13*b* may receive and set whether or not the process includes the "preprocessing" through user input via the UI screen. Further, the print condition setting section 13*b*, if it has been set that the process includes the "preprocessing", may receive presence/absence of the back feed through user input via the UI screen.

In the case where the process is set as the one including the "preprocessing", the unevenness setting section 13*c* sets the size of S ink dots and print resolution dpi (kind of coarseness and fineness) based on the index of the metallic quality having been received in step S110 (step S120). For example, of the combinations of dot size and print resolution having been prepared beforehand as data, the unevenness setting section 13*c* selects and sets a combination that corresponds to the index of the metallic quality.

Figure 4A:
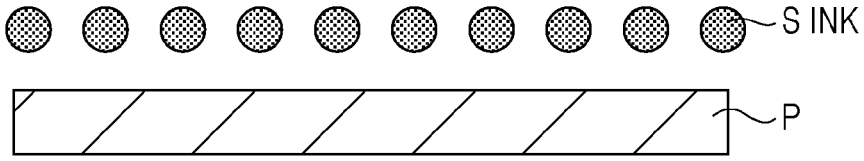
FIGS. 4A through 4C are diagrams illustrating in a simplified manner an example of a flow of printing that includes preprocessing.
Figure 4B:
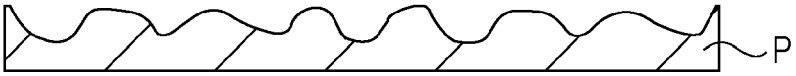
Figure 4C:
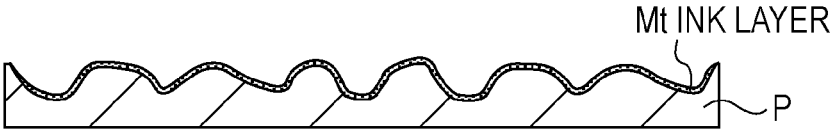
Figure 5A:
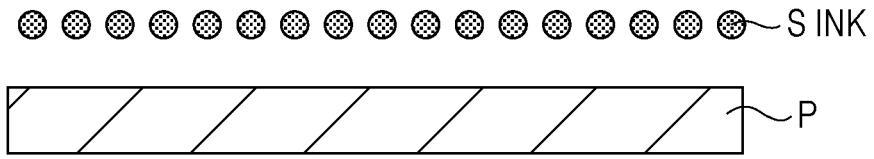
FIGS. 5A through 5C are diagrams illustrating in a simplified manner an example of a flow of printing that includes preprocessing.
Figure 5B:
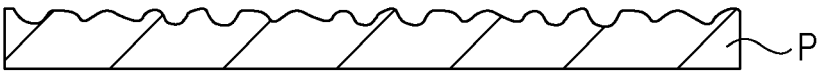
Figure 5C:
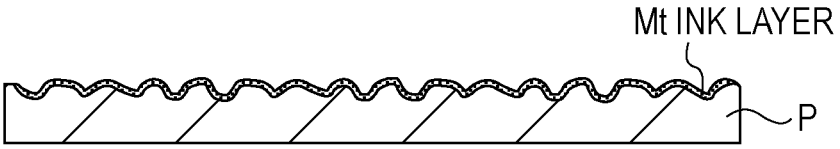

FIGS. 4A through 4C and FIGS. 5A through 5C exemplify flows of printing including the preprocessing performed by the printer 50, using the cross-sections of print media P. FIG. 4A and FIG. 4B illustrate a state in which S ink of a dot size and print resolution according to a first combination (large dots and first print resolution) is discharged onto the print medium P and then a surface of the print medium P is partly dissolved. Meanwhile, FIG. 5A and FIG. 5B illustrate a state in which S ink of a dot size and print resolution according to a second combination (small dots and high-resolution second print resolution which is higher than the first print resolution) onto the print medium P and then the surface of the print medium P is partly dissolved. As can be understood by comparing FIGS. 4A and 4B with FIGS. 5A and 5B, in the case where the S dot size is larger and the print resolution is lower, unevenness formed on the print medium is larger (deeper) and a generation cycle of the unevenness is lower. When the unevenness formed on the print medium P is larger and its generation cycle is lower, roughness of the surface (unevenness) becomes more prominent. Accordingly, if an Mt ink layer is formed (see FIG. 4C) on the surface on which the unevenness has been formed as shown in FIG. 4B, it is possible to make a user further strongly recognize the "first metallic quality". Meanwhile, if an Mt ink layer is formed (see FIG. 5C) on the surface on which the unevenness has been formed as shown in FIG. 5B (surface whose unevenness is relatively not prominent), it is possible to make the user further strongly recognize the "second metallic quality".

Accordingly, in the case where the above-discussed index specifies that the first metallic quality is given a higher priority, the unevenness setting section 13*c* selects and sets a combination of dot size and print resolution as described in FIG. 4A from among the combinations of dot size and print resolution having been prepared beforehand, for example. On the other hand, in the case where the index specifies that the second metallic quality is given a higher priority, the unevenness setting section 13*c* selects and sets a combination of dot size and print resolution as described in FIG. 5A from among the combinations of dot size and print resolution having been prepared beforehand, for example. Needless to say, the number of kinds of the combinations of dot size and print resolution that can be selected by the unevenness setting section 13*c* need not be limited to two; the combinations may be prepared according to the indexes that can be selected by a user. Further, as for the combinations of dot size and print resolution that can be selected by the unevenness setting section 13*c*, it may be sufficient that at least one of the dot size and print resolution in each combination differs from those in other combinations. In addition, the rates of dot sizes may be varied according to the indexes that can be selected by the user (that is, a large dot generation rate may be more increased as the index specifies a higher priority to the first metallic quality).

In any case, the unevenness setting section 13*d* sets an S ink dot size (size rate) and print resolution that make the unevenness of a print medium surface more prominent as the index specifies a higher priority to the first metallic quality. The shape of unevenness of the print medium surface has a direct influence on the shape of unevenness of the Mt ink layer to be formed later on the print medium surface. Therefore, setting an S ink dot size (size rate) and print resolution corresponds to the processing of setting a degree of unevenness of the Mt ink layer.

Next, the coarseness and fineness setting section 13*d* sets a method of HT processing to be applied to the tone of the Mt ink in accordance with the index of the metallic quality which has been received in step S110 (step S130). Different methods of HT processing produce different modes of dot dispersiveness in a printed result. It can be stated that a higher dot dispersiveness produces an image of smooth quality as a whole, while a lower dot dispersiveness produces an image of prominent granular quality.

For example, comparing a dither method with an error diffusion method as HT processing, a higher dot dispersiveness can be obtained by using the error diffusion method. It is possible for the dither method to make the dot diverseness differ by preparing a plurality of dither masks whose characteristics are different from each other, such as dot dispersive dither masks and dot concentrated dither masks, and employing any one of the dither methods using different dither masks. It is also possible for the error diffusion method to make the dot dispersiveness differ by preparing a plurality of error diffusion methods in which threshold values used by each pixel, diffusion directions of errors, and so on are different from each other, and employing any one of the error diffusion methods prepared. In any case, the coarseness and fineness setting section 13*d* selects and sets HT processing that further lowers the dot dispersiveness from among the plurality of previously prepared HT processings as the index specifies a higher priority to the first metallic quality.

Figure 6A:
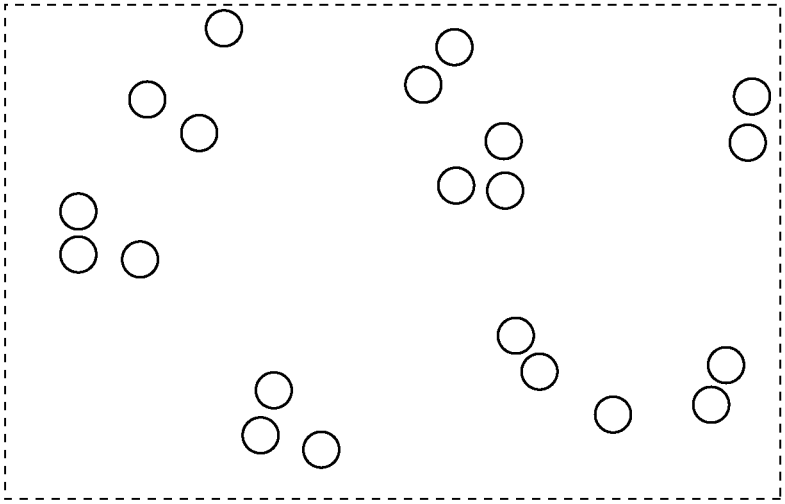
FIGS. 6A and 6B are diagrams illustrating examples of different dot arrangements in a set region of a print medium.
Figure 6B:
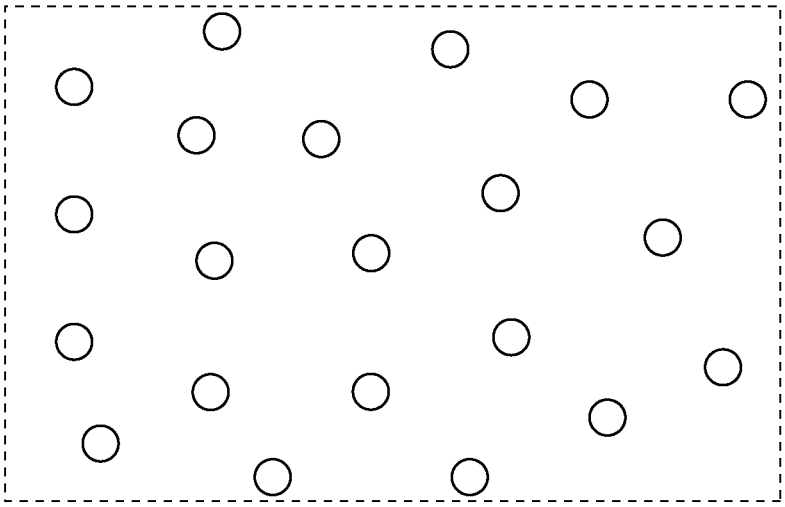

FIGS. 6A and 6B illustrate examples of arrangements of dots (white circles) in a set region on a print medium (a rectangle indicated by a chain line). FIG. 6A illustrates a dot arrangement based on a processed result by a low-dispersiveness HT processing, and FIG. 6B illustrates a dot arrangement based on a processed result by a high-dispersiveness HT processing. According to FIG. 6A, because dot dispersiveness is lower, dots are locally and densely formed in a plurality of areas inside the set region. Therefore, it can be stated that the Mt ink dot arrangement as shown in FIG. 6A produces a strong granular quality and makes a user further strongly recognize the "first metallic quality". According to FIG. 6B, on the other hand, because dot dispersiveness is higher, dots are not locally and densely formed, but formed substantially in a uniform manner across the overall set region. Accordingly, it can be stated that the Mt ink dot arrangement as shown in FIG. 6B produces a weak granular quality and makes the user further strongly recognize the "second metallic quality". As described thus far, a difference in dot dispersiveness is also a difference in coarseness and fineness of dots at local areas in a printed result. Therefore, setting an HT processing method that is applied to the Mt ink tone corresponds to the processing of setting a degree of coarseness and fineness of the Mt ink dots.

In step S140, the print control section 13*e* creates S ink data in which an S ink dot size and ink dot discharge/non-discharge information at the respective pixel positions are defined in accordance with the dot size (size rate) and the print resolution that have been set in step S120 as described above. Further in step S140, the image data acquisition section 13*a* acquires image data expressing the print target image. The image data is acquired from predetermined storage regions such as the HDD 20, a memory card mounted to a connector for external connection (not shown), and so on. The acquired image data is, for example, an RGB image in which every pixel has a tone configured of red (R), green (G), and blue (B). The print control section 13*e* color-converts the tone of each pixel (R, G, B) of the RGB image to the tone in the form of ink amounts (C, M, Y, K, Mt). The color conversion can be executed by referring to a color conversion lookup table or the like in which a correspondence relationship between (R, G, B) and (C, M, Y, K, Mt) is previously defined and stored in the HDD 20 or the like.

The print control section 13*e* performs the dot assignment processing on the tone of each pixel (C, M, Y, K, Mt) in the form of ink amounts obtained through the color conversion, and further performs the HT processing thereupon. In this case, the method of HT processing having been set in step S130 as described above is applied to at least the tone indicating the amount of Mt ink (dot forming amount). Thereafter, a print command is generated as described earlier, and the generated print command is transmitted to the printer 50 (step S150). As a result, in the printer 50, the print command is interpreted, whereby the preprocessing (discharge of S ink onto the print medium according to the S ink data, back feed, and so on) is performed and further Mt ink or other inks of C, M, Y, and K are discharged onto the print medium in accordance with the print data created from the image data of the print target image.

According to the first example described above, unevenness of the Mt ink layer formed on a print medium and coarseness and fineness of the Mt ink dots on the print medium are controlled in accordance with an index of the metallic quality that is arbitrarily specified by a user. In other words, because at least a dot size of S ink used in the preprocessing is adjusted and a method of HT processing that determines whether or not to form the Mt ink dots is changed in accordance with the above index, the shape of unevenness of the print medium surface (≈shape of unevenness of the Mt ink layer) is controlled and also controlled is the coarseness and fineness of the Mt ink dots. That is, it is possible to flexibly adjust the metallic quality in a printed result produced by using the Mt ink in accordance with a request from a user, and to reproduce the metallic quality (strengthen the first metallic quality, strengthen the second metallic quality, or the like) with high precision that meets the request from the user.

Second Example

Next, another specific example of the print control process based on FIG. 3 will be described as a second example. The second example is intended to describe a case in which the process not including the "preprocessing" is employed.

Figure 7:
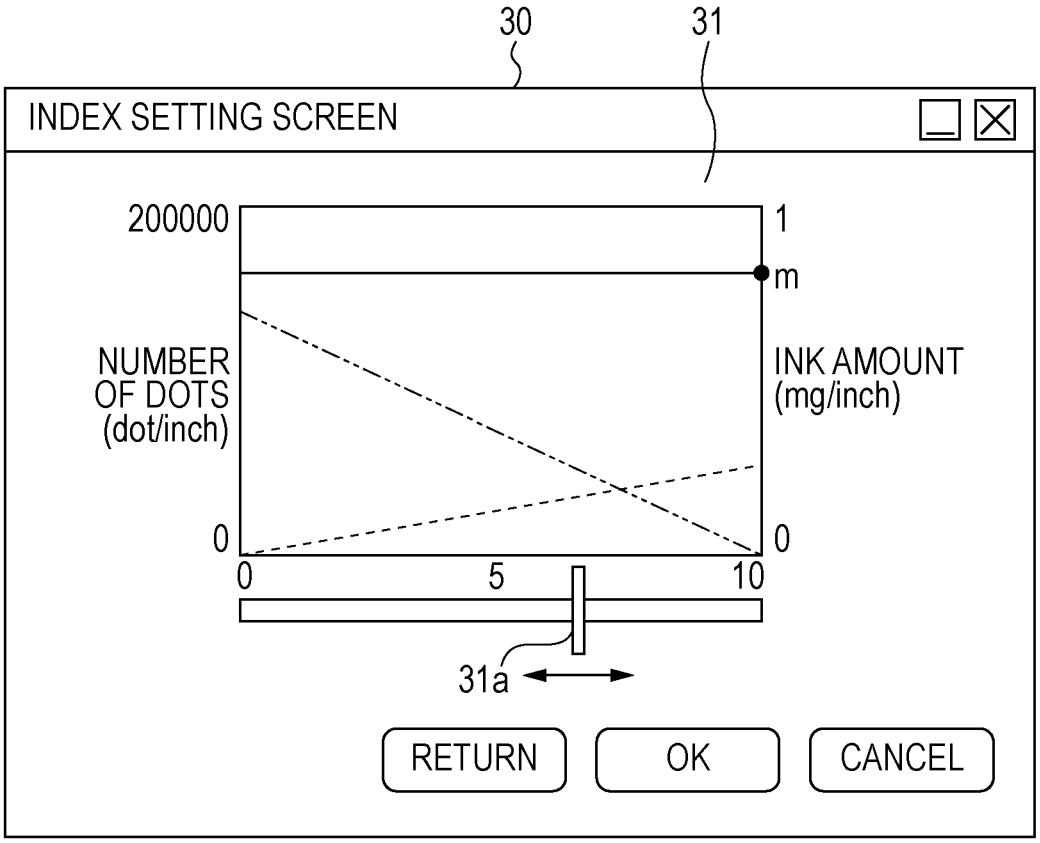
FIG. 7 is a diagram illustrating an example of an index setting screen.

FIG. 7 exemplifies an index setting screen 31 that is displayed on the display 30 as one type of the UI screen in step S110. The index setting screen 31 includes an index as illustrated therein and a graph showing a relation between an ink amount and the number of dots. The horizontal axis of the graph represents a numerical value range of the index (for example, 0 to 10), while the vertical axis thereof represents the ink amount and the number of dots. Further, the number of small dots needed to supply a set ink amount "m" (indicated by a double-dot dash line) and the number of large dots needed to supply the set ink amount "m" (indicated by a chain line) are illustrated corresponding to change of the index. The index means that only the small dots achieve the set ink amount "m" when the index takes a minimum value, and that only the large dots achieve the set ink amount "m" when the index takes a maximum value. A higher granular quality can be given to a user as the dot size is larger. Therefore, the index means that the priority of the "first metallic quality" is higher as the value of the index is larger, and that the priority of the "second metallic quality" is higher as the index value is lower.

A user can select an index value as desired while referring to the graph described above. As shown in FIG. 7, for example, the index setting screen 31 may display a slider bar 31*a* for the selection of the index value. The user operates the operation unit 40 to move the position of the slider bar 31*a* between the minimum value of the index and the maximum value of the index as desired so as to obtain a desired index. It is needless to say that a specific design of the index setting screen 31 is not limited to the design described above; any design may be adopted as long as a user can input an index of the metallic quality in a direct or indirect manner.

With the setting of the process not including the "preprocessing", the unevenness setting section 13*c* sets use rates of the Mt ink dot sizes based on the index of the metallic quality that the print condition setting section 13*b* has received in step S110 (step S120).

Figure 8A:
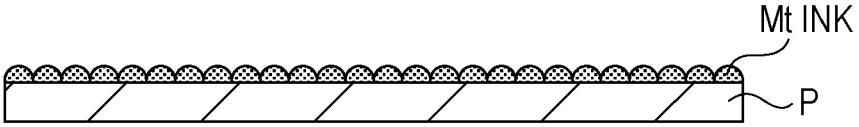
FIGS. 8A and 8B are diagrams illustrating examples of printed results with different use rates of dot sizes.
Figure 8B:
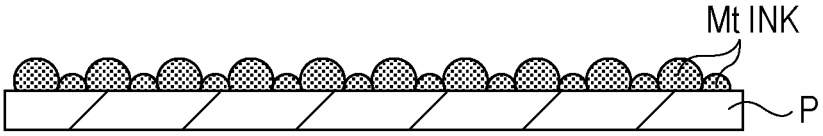

FIGS. 8A and 8B exemplify, using cross-sections of the print media P, the states in which printing is performed adopting different use rates of the Mt ink dot sizes. As extreme examples, FIG. 8A illustrates a case in which only small dots of the Mt ink are used, and FIG. 8B illustrates a case in which small and large dots of the Mt ink are used at a rate of 1 to 1. As can be understood from the drawings, in the case where a large dot rate is larger (FIG. 8B), unevenness formed on the print medium P is larger and roughness of the surface is more prominent. Accordingly, an Mt ink layer as shown in FIG. 8B makes a user more strongly recognize the "first metallic quality" than an Mt ink layer as shown in FIG. 8A. Therefore, the unevenness setting section 13*c* sets the use rate of large dots of the Mt ink to be increased if the index specifies that a higher priority is given to the first metallic quality, or sets the use rate of small dots of the Mt ink to be increased if the index specifies that a higher priority is given to the second metallic quality. As a specific method in this case, for example, through adjusting a dot assignment table prepared beforehand, the unevenness setting section 13*c* sets the use rates of the Mt ink dot sizes.

Figure 9:
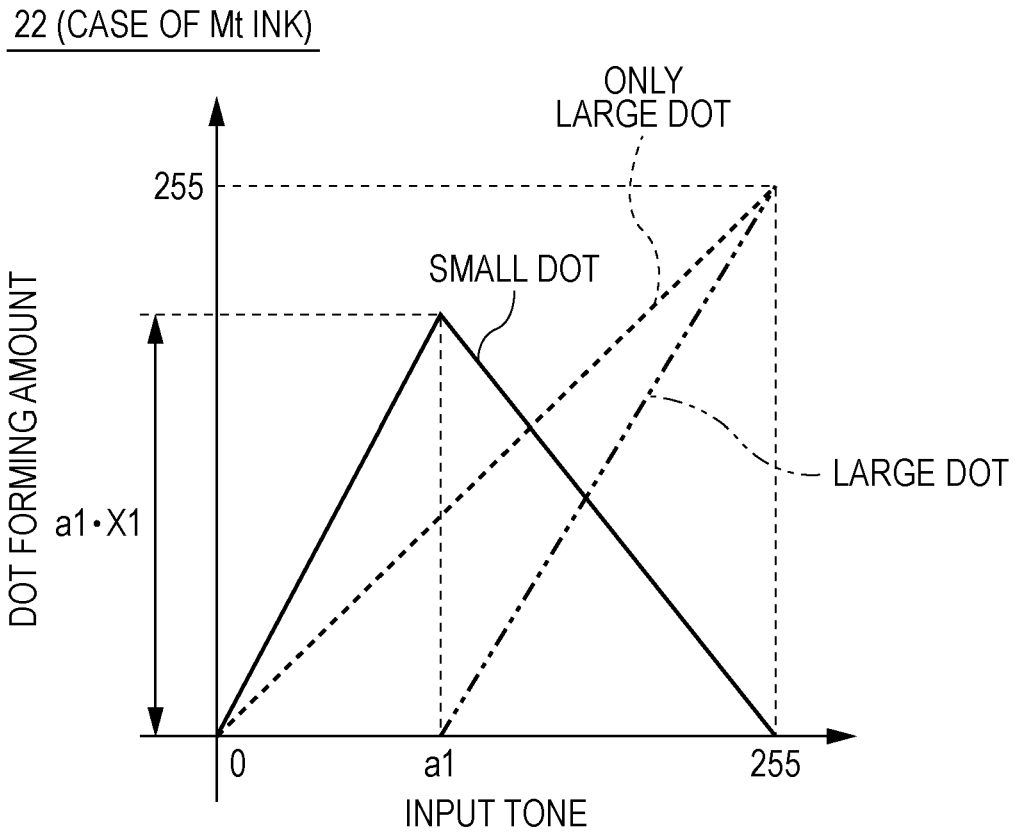
FIG. 9 is a diagram illustrating an example of a dot assignment table.

FIG. 9 exemplifies a dot assignment table 22. The dot assignment table 22 is created beforehand for each ink that is used in the printer 50, for example, and is stored in the HDD 20 or the like. The dot assignment table 22 in FIG. 9 is shown relating to Mt ink. The dot assignment table 22 is a table that converts a tone indicating an ink amount (0-255) to a dot forming amount per large dot (tone 0-255) and a dot forming amount per small dot (tone 0-255), and is used in the dot assignment processing. Here, an example of a method of creating the dot assignment table 22 is briefly explained. First, a substitution ratio X1 of small dots with respect to large dots is determined. The substitution rate X1 is the number of small dots (of Mt ink) that need be discharged onto a print medium by a printer so as to realize an equivalent hue to the hue realized by a single large dot (of Mt ink) that has been discharged onto the print medium by the printer.

Next, as indicated by a chain line in FIG. 9, assuming that the printing is performed using only large dots, it is defined that there is a correlation such that the dot forming amount of large dots increases linearly (proportionally) from 0 to 255 when the input tone increases linearly (in a straight line) from 0 to 255. Then, such processing is performed that the forming amount of small dots is substituted for the forming amount of large dots. Here, a maximum of the forming amount of small dots is set to a value of a1·X1. Since the small dot substitution ratio is X1, and the correlation associated only with the large dots and indicated by the chain line forms a straight line with an inclination of 1, a straight line with an inclination of X1 is formed with regard to the small dots. Accordingly, a table (function) for converting to the dot forming amount of small dots forms a straight line (solid line) with the inclination of X1 with respect to the input tone ranging from 0 to a1, and also forms a straight line (solid line) with an inclination of −a1·X1/(255−a1) with respect to the input tone ranging from a1 to 255. As a result, the forming amount of large dots is 0 with the input tone from 0 to a1; with the input tone from a1 to 255, the dot forming amount indicated by a double-dot dash line in the drawing represents the forming amount of large dots.

On the premise that there exits the dot assignment table 22 as a criterion, in step S120, the unevenness setting section 13*c* changes (increases/decreases) the maximum value a1·X1 of the small dot forming amount in the dot assignment table 22 as the criterion in accordance with the above-discussed index so as to adjust (reconstruct) the dot assignment table 22. However, in the case where the index takes an intermediate value ("5" in the example of FIG. 7), the maximum value a1·X1 of the small dot forming amount will not be changed. In the case where the index takes a value other than the intermediate value, the maximum value a1·X1 of the small dot forming amount is changed to a predetermined value in accordance with the index. In this case, as the index takes a higher value, the post-change maximum value a1·X1 takes a lower value; as the index takes a lower value, the post-change maximum value a1·X1 takes a higher value. As described above, the substitution ratio X1 is known. Therefore, a table top position of the small dot (maximum dot forming amount) that is defined by the dot assignment table 22 and a large dot generation start positional are changed in accordance with the above index.

To be more specific, in the case where the index takes a value higher than the intermediate value, the table top position of the small dot is lowered and the large dot generation start positional is also lowered. In this case, comparing the dot assignment table 22 as the criterion with the post-adjustment dot assignment table 22, the small dot forming amount is reduced and the large dot forming amount is increased in the post-adjustment dot assignment table 22. In other words, the use rate of the large dots is increased. Meanwhile, in the case where the index takes a value lower than the intermediate value, the table top position of the small dot is raised and the large dot generation start positional is also raised. In this case, comparing the dot assignment table 22 as the criterion with the post-adjustment dot assignment table 22, the small dot forming amount is increased and the large dot forming amount is reduced in the post-adjustment dot assignment table 22. In other words, the use rate of the small dots is increased.

As described before, the use rates of Mt ink dots of different sizes have a direct influence on the shape of unevenness of an Mt ink layer formed on a print medium. Accordingly, the setting of the use rates of Mt ink dot sizes corresponds to the setting of a degree of unevenness of the Mt ink layer. Explanation of step S130 to be executed next is omitted here because there is not any specific difference in processing between step S130 in the first example and step 130 in the second example.

In step S140, the print control section 13*e* performs the dot assignment processing, using the dot assignment tables respectively prepared for each of the inks, on the tone of each pixel in the form of ink amounts (C, M, Y, K, Mt) obtained through the above-described color conversion. In this case, the dot assignment processing is performed on the tone of the Mt ink according to the dot assignment table 22 that has been adjusted in step S120 as described above. Thereafter, as described above, the HT processing and the like are performed and then a print commands is transmitted to the printer 50 (step S150). As a result, in the printer 50, the print command is interpreted, whereby Mt ink or other inks of C, M, Y, and K are discharged onto the print medium in accordance with the print data created from the image data of the print target image.

As described above, also in the second example, unevenness of an Mt ink layer formed on a print medium and coarseness and fineness of Mt ink dots on the print medium are controlled in accordance with an index of the metallic quality that is arbitrarily specified by a user. In particular, because the use rates of Mt ink dot sizes are changed in accordance with the above index, the shape of unevenness of the Mt ink layer is appropriately controlled. That is, it is possible to flexibly adjust the metallic quality in a printed result produced by using Mt ink in accordance with a request from a user, and reproduce the metallic quality (strengthen the first metallic quality, strengthen the second metallic quality, or the like) with high precision that meets the request from the user.

3. Variations

The invention is not limited to the above-described embodiment and practical examples, and can be embodied in various modes without departing from the scope and spirit of the invention; for example, variations can be made as described below. Moreover, those that are realized by appropriately combining the above embodiment, practical examples, and following variations are also within the disclosed scope of the invention.

First Variation

In the first example, although the shape of unevenness formed on a print medium surface is adjusted by adjusting a dot size of S ink and print resolution used in the preprocessing, adjustment of the shape of unevenness of the print medium surface using S ink is not limited to the above method. That is, it is assumed that the printer 50 can discharge a plurality of solvent inks (for example, S1 ink, S2 ink) respectively through predetermined nozzle rows, in which the solvent inks have different capabilities to dissolve the surface of a print medium. In this case, it is also assumed that the S1 ink has a higher capability to dissolve the print medium than the S2 ink. Under such conditions, if it is set that the process includes the "preprocessing", the unevenness setting section 13*c* sets the use rates of the S1 and S2 inks in accordance with the index of the metallic quality having been received in step S110 (step S120).

As the use rate of the S1 ink in the total amount of S ink used in the preprocessing is higher, the surface of the print medium is more largely dissolved so that the shape of unevenness becomes prominent. Accordingly, the unevenness setting section 13*c* sets the use rate of the S1 ink higher (that is, the use rate of the S1 ink is set lower) as the index specifies a higher priority to the first metallic quality. In step S140, the print control section 13*e* creates S ink data in which whether or not to discharge the S1 or S2 ink is defined at each pixel position in accordance with the use rates of the S1 and S2 inks which have been set in step S120 as described above. In other words, adjusting the use rates of the plurality of different solvent inks makes it possible to adjust the shape of unevenness formed on the print medium surface. The method described above is useful in the case where a printer that does not have a function to discharge dots of different sizes is employed.

Second Variation

Adjustment of the shape of unevenness formed on a print medium surface using S ink can be realized by other methods. For example, in the case where the process is set as the one including the "preprocessing", the unevenness setting section 13*c* adjusts coarseness and fineness of the S ink dots in accordance with the index of the metallic quality having been received in step S110 (step S120). Note that the adjustment of the coarseness and fineness just mentioned above is performed substantially in the same manner as in step S130, and a method of HT processing to be applied in the creation of the S ink data is set in accordance with the above-discussed index. In this case, as the index specifies a higher priority to the first metallic quality, the unevenness setting section 13*c* selects and sets HT processing that produces a lower dot dispersiveness from among a plurality of HT processings previously prepared.

In step S140, in order to create the S ink data in which whether or not to discharge S ink at each pixel position is defined, the print control section 13*e* performs the HT processing having been set in step S120 as described above (the HT processing is performed on an image that includes tones each indicating an ink amount of S ink in each pixel). Since the preprocessing is performed by the printer 50 in accordance with the S ink data created in the above manner, a print medium across the surface of which unevenness produced by the attached S ink dots is uniformly formed as a whole can be obtained, for example, or conversely a print medium on the surface of which the unevenness is non-uniformly formed and distributed (a print medium of higher granular quality) can be obtained. In other words, adjusting the coarseness and fineness of S ink dots makes it possible to adjust the shape of unevenness formed on the print medium surface. The method described above is useful in the case where a printer that does not have a function to discharge dots of different sizes or a function to discharge a plurality of types of S ink is employed.

Needless to say, regarding the adjustment of the shape of unevenness formed on a print medium surface using S ink, the unevenness setting section 13*c* may combine all or part of the first example and the first and second variations. For example, use rates of a plurality of types of S ink used in the preprocessing, dot sizes of those S inks, and coarseness and fineness thereof (a method of HT processing) may be adjusted in accordance with the index. Further, in the first example, although it is described that the coarseness and fineness of the S ink is controlled by changing the print resolution dpi as a kind of coarseness and fineness of the S ink, the coarseness and fineness of the S ink may be changed in accordance with the index of the metallic quality while the print resolution dpi being maintained to be the same. For example, as described earlier, the coarseness and fineness may be controlled by changing the setting of the HT processing that is performed on the S ink in the preprocessing.

Third Variation

With regard to the control of unevenness of the Mt ink layer, the first example (including the first and second variations) and the second example may be combined together. That is, in accordance with the index, the unevenness of the Mt ink layer may be adjusted through adjusting the shape of unevenness of a print medium by the S ink and adjusting the use rates of Mt ink dot sizes.

Fourth Variation

Thus far, the case in which the computer 10 performs the print control process has been described as an example. However, the print control process may be performed in the printer 50. In other words, a CPU 51 of the printer 50 may execute firmware FW (print control program) so as to implement the above-described functions such as those of the image acquisition section 13*a*, the print condition setting section 13*b*, the unevenness setting section 13*c*, the coarseness and fineness setting section 13*d*, and the print control section 13*e* in the printer 50, whereby the flowchart in FIG. 3 may be realized. The CPU 51 receives print conditions of a print target image, the index, and the like from a user via the operation panel 59. Further, the index setting screen 31 or the like may be displayed on the display unit included in the operation panel 59. Alternatively, the process of the flowchart in FIG. 3 may be realized such that the printer driver 13 and the firmware FW share the process illustrated therein.

The entire disclosure of Japanese Patent Application No. 2012-246350, filed Nov. 8, 2012 is expressly incorporated by reference herein.

What is claimed is:

1. A print control apparatus capable of carrying out printing on a print medium using metallic ink, comprising:

a controller configured to:

identify an index of metallic quality that relates to two or more metallic qualities;

control an unevenness of a metallic ink layer formed by the metallic ink on the print medium based on the index of metallic quality by shaping a surface of the print medium, wherein the unevenness of the metallic ink layer is controlled by attaching, to the print medium, a solvent for dissolving a surface of the print medium to form unevenness on the surface of the print medium before the metallic ink layer is formed on the print medium, and control a coarseness and a fineness of dots of the metallic ink on the print medium based on the index of metallic quality.

2. The print control apparatus according to claim 1, wherein the print control apparatus controls the unevenness of the metallic ink layer by adjusting use rates of a plurality of dots in different sizes of the metallic ink.

3. The print control apparatus according to claim 1, wherein the print control apparatus adjusts a shape of the unevenness on the surface by adjusting size of dots of the solvent to be attached to the print medium.

4. The print control apparatus according to claim 1, wherein the print control apparatus adjusts the shape of the unevenness on the surface of the print medium by adjusting use rates of a plurality of the solvents having different capabilities to dissolve the surface of the print medium.

5. The print control apparatus according to claim 1, wherein the print control apparatus adjusts the shape of the unevenness on the surface by adjusting coarseness and fineness of dots of the solvents to be attached to the print medium.

6. The print control apparatus according to claim 1, wherein the print control apparatus controls the coarseness and fineness of the metallic ink dots by changing a method of halftone processing that determines whether or not to form the metallic ink dots at each individual position in the print medium.

7. A print control method for carrying out printing on a print medium using metallic ink, comprising:

identifying an index of metallic quality that relates to two or more metallic qualities;

controlling an unevenness of a metallic ink layer formed by the metallic ink on the print medium based on the index of metallic quality by shaping a surface of the print medium wherein the unevenness of the metallic ink layer is controlled by attaching, to the print medium, a solvent for dissolving a surface of the print medium to form unevenness on the surface of the print medium before the metallic ink layer is formed on the print medium, and controlling a coarseness and a fineness of dots of the metallic ink on the print medium based on the index of metallic quality.

8. A print control apparatus capable of carrying out printing on a print medium using metallic ink, comprising:

a controller configured to:

control an unevenness of a metallic ink layer formed by the metallic ink on the print medium based on the index of metallic quality by shaping a surface of the print medium, wherein the unevenness of the metallic ink layer is controlled by attaching, to the print medium, a solvent for dissolving a surface of the print medium to form unevenness on the surface of the print medium before the metallic ink layer is formed on the print medium, and control a coarseness and a fineness of dots of the metallic ink on the print medium based on the index of metallic quality.

* * * * *